US012606771B2

(12) United States Patent
Dura et al.

(10) Patent No.: US 12,606,771 B2
(45) Date of Patent: Apr. 21, 2026

(54) GREASE COMPOSITION

(71) Applicant: The Lubrizol Corporation, Wickliffe, OH (US)

(72) Inventors: Robert D. Dura, Broadview Heights, OH (US); Jennifer E. Clark, Aurora, OH (US); Carlos Alberto Nazario, Willoughby, OH (US); Amanda E. Freshwater, Avon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/867,472

(22) PCT Filed: May 23, 2023

(86) PCT No.: PCT/US2023/023217

§ 371 (c)(1),
(2) Date: Nov. 20, 2024

(87) PCT Pub. No.: WO2023/230051

PCT Pub. Date: Nov. 30, 2023

(65) Prior Publication Data

US 2025/0215348 A1 Jul. 3, 2025

Related U.S. Application Data

(60) Provisional application No. 63/344,841, filed on May 23, 2022.

(51) Int. Cl.

| | |
|---|---|
| ***C10M 169/00*** | (2006.01) |
| ***C10M 103/02*** | (2006.01) |
| ***C10M 117/04*** | (2006.01) |
| ***C10M 137/02*** | (2006.01) |
| ***C10M 137/10*** | (2006.01) |
| *C10N 30/00* | (2006.01) |
| *C10N 30/06* | (2006.01) |
| *C10N 30/12* | (2006.01) |
| *C10N 50/10* | (2006.01) |

(52) U.S. Cl.

CPC ..... *C10M 169/00* (2013.01); *C10M 103/02* (2013.01); *C10M 117/04* (2013.01); *C10M 137/02* (2013.01); *C10M 137/10* (2013.01); *C10M 137/105* (2013.01); *C10M 2201/0413* (2013.01); *C10M 2203/003* (2013.01); *C10M 2207/1285* (2013.01); *C10M 2223/02* (2013.01); *C10M 2223/045* (2013.01); *C10M 2223/047* (2013.01); *C10M 2223/049* (2013.01); *C10N 2030/06* (2013.01); *C10N 2030/12* (2013.01); *C10N 2030/45* (2020.05); *C10N 2050/10* (2013.01)

(58) Field of Classification Search

CPC ..... C10N 2030/45; C10N 2030/06; C10N 2030/12; C10N 2050/10; C10M 169/00; C10M 103/02; C10M 117/04; C10M 137/02; C10M 137/10; C10M 137/105; C10M 2201/0413; C10M 2203/003; C10M 2207/1285; C10M 2223/02; C10M 2223/045; C10M 2223/047; C10M 2223/049

See application file for complete search history.

(56) References Cited

U.S. PATENT DOCUMENTS 6,103,673 A * 8/2000 Sumiejski ..... C10M 167/00 508/195

2018/0282654 A1 10/2018 Abraham et al.

* cited by examiner

*Primary Examiner* — Vishal V Vasisth

(74) *Attorney, Agent, or Firm* — Iken S. Sans; Michael A. Miller

(57) ABSTRACT

The instant disclosure provides a grease composition containing an ash-free phosphonate ester mixture, which comprises of an ash-free phosphonate ester mixture of a cyclic phosphonate ester species and an oligomeric phosphonate ester species. The grease composition further includes a metallic soap thickener. The grease compositions disclosed herein demonstrate improved anti-wear protection under very demanding conditions and load carry.

20 Claims, No Drawings

GREASE COMPOSITION

CROSS REFERENCE TO RELATED APPLICATION

This application claims priority from PCT Application Serial No. PCT/US2023/023217 filed on May 23, 2023, which claims the benefit of U.S. Provisional Application No. 63/344,841 filed on May 23, 2022, both of which are incorporated in their entirety by reference herein.

FIELD OF INVENTION

The instant disclosure provides a grease composition containing an ash-free phosphonate ester mixture and a metallic soap thickener. The invention further relates to methods of using the grease composition.

BACKGROUND OF THE INVENTION

Open gear lubricants usually possess properties including tackiness to allow adhesion to gears, washout resistance, corrosion/finish/wear protection, and cushioning without buildup. Grease type open gear lubricants are typically utilized for the lubrication of open gear systems found in, for example, draglines and electric rope shovel excavators, and other equipment found in the large open pit mining industry. Open gear lubricants generally function under boundary lubrication conditions due to the extremely high loads they experience in addition to demanding a lubricant formulation that can survive in this environment without causing damage to the equipment.

Duty cycles of these open gear systems typically include a short duration start, stop, and reversal of forward motion that can be considered high speed operation (30-43 m/s). This mode of operation is challenging for traditional lubricants and thus proper selection of lubrication is important to protect such components. Typical open gear lubricants require high sulfur content in order to meet the high load specifications, which can increase negative complications to the gears, such as increased wear. Therefore, there is a need in the art for open gear lubricants that meet the high carrying loads of open gear systems will minimizing negative impacts to the gears and equipment. Accordingly, the present disclosure provides a grease-type open gear lubricant that provides, among other things, lubrication and wear protection.

SUMMARY OF THE INVENTION

The present disclosure provides a grease composition comprising an ash-free phosphonate ester mixture and a metallic soap thickener. The grease compositions of the instant disclosure include an ash-free phosphonate ester mixture that includes a cyclic phosphonate of the following formula:

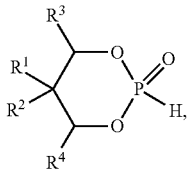

where, $R^1$, $R^2$, $R^3$, and $R^4$ are independently selected from one of hydrogen, a hydrocarbyl groups of 1 to 24 or 1 to 12 carbon atoms and an oligomeric phosphonate of the following formula:

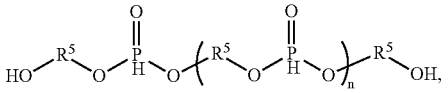

where each $R^5$ is independently a linear or branched hydrocarbyl group of 3 to 24 carbon atoms, and n is an integer from 1 to 8. The grease composition further including a metallic soap thickener as described herein.

The disclosure also provides a method for lubricating a mechanical device. Such method includes supplying to a mechanical device selected from one or more of draglines, rope shovels, and mining equipment the grease composition described above. Further, the instant disclosure provides for use of the grease composition to do one or more of decrease wear and corrosion is a mechanical device.

DETAILED DESCRIPTION OF THE INVENTION

The disclosure described herein provides a grease composition comprising an ash-free phosphonate ester mixture and a metallic soap thickener and methods of using said grease composition and uses of the grease composition.

Phosphonate Ester Mixture

The grease composition of the present invention comprises an ash-free phosphonate ester mixture. The phosphonate ester mixture composition may comprise a two or more phosphonate ester species. The phosphonate ester mixture may be other than a zinc salt, that is it may be a composition that is substantially free of zinc. As used herein, "substantially free" means that the amount of the material in question is less than an amount that will affect the relevant performance of the lubricant in a measurable way. In one embodiment, the grease composition of the instant disclosure is substantially free of zinc. In another embodiment, the grease composition is ash-free.

The phosphonate ester mixture includes phosphonate esters comprised of the reaction product, e.g., condensation product, of phosphonic acid ($H_3PO_3$), or a monomeric ester thereof (i) with at least one propanediol (ii). By "monomeric" phosphonate ester is meant a phosphonate ester, typically containing one phosphorus atom and having two separate alkyl groups of from one to six carbon atoms each, which may be reacted with the polyol in order to form an oligomeric, polymeric, or other condensed species. The alkyl groups of the monomeric phosphonate ester may be relatively low molecular weight groups of 1 to 6 or 1 to 4 carbon atoms, such as methyl, ethyl, propyl, or butyl, such that the alcohol generated upon reaction with the alkylene diols may be easily removed. An exemplary monomeric phosphonate ester is dimethyl phosphite; others include diethyl phosphite, dipropyl phosphite, and dibutyl phosphite. Accordingly, in some embodiments, the monomeric phosphonate ester used to make the cyclic phosphonate ester may comprise dimethyl phosphite.

Sulfur-containing analogues may also be employed (e.g., thiophosphites). Other esters include trialkyl phosphites. Mixtures of di-and trialkyl phosphites may also be useful. In these materials, the alkyl groups may be the same or different each independently typically having 1 to 6 or 1 to 4 carbon atoms as described above.

The monomeric phosphonate ester (i) will be reacted or condensed with at least one propanediol (ii) to form the material of the disclosed technology, which includes a monomeric cyclic phosphonate species. The propanediol may have at least one hydroxy group in both the 1 and 3 positions and one or more of the carbon atoms of the propyl units are substituted with one or two alkyl groups such that the total number of carbon atoms in the propanediol ranges from 4 to 12. The molar ratio of the phosphonic acid or ester (i) to the propanediol (ii) may be 0.9:1.1 to 1.1 to 0.9. In some embodiments, the propanediol may comprise an alkyl-substituted 1,3-propanediol with one or more of the alkyl substituents thereof being on one or more of the carbon atoms of the propyl unit such that the total number of carbon atoms in the diol ranges from 5 to 12 or 6 to 12 or 7 to 12 or 8 to 12 or, in certain embodiments, 9 to 12, or even 9. That is, the alkyl-substituted propanediol may be represented by the general formula:

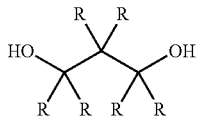

where the various R groups may be the same or different and may be hydrogen or a hydrocarbyl group, provided that at least one R is an alkyl group and that the total number of carbon atoms in the R groups is 2 to 9 or 3 to 9, so that the total carbon atoms in the diol will be 1 to 24 or 3 to 24 or 5 to 16 or 6 to 12 or 3 to 12, respectively, and likewise for the other ranges of total carbons. Reference here to propanediols means that the two hydroxy groups are in a 1,3 relationship to each other, that is, separated by a chain of 3 carbon atoms. Thus, the propanediol may thus also be named as a 2,4- or 3,5- or 4,6-diol depending on the position of the two hydroxy groups on the longest alkyl chain of the molecule. If the 1,3-propaendiol has one or more secondary hydroxy groups, such a molecule will be considered to be an internal diol. In one embodiment the number of alkyl substituents is two and the total number of carbon atoms in the molecule is 9. Suitable substituents may include, for instance, methyl, ethyl, propyl, and butyl (in their various possible isomers).

Examples of a suitable 1,3-propanediol may include 2,2-dimethyl-1,3-propanediol, 2-ethyl-2-butyl-1,3-propanediol, 2-ethyl-1,3-hexanediol, 2,2-dibutyl-1,3-propanediol, 2,2-diisobutyl-1,3-propanediol, 2-methyl-2-propyl-1,3-propanediol, 2-propyl-1,3-propanediol, 2-butyl-1,3-propanediol, 2-pentyl-1,3-propanediol, 2-methyl-2-propyl-1,3-propanediol, 2,2-diethyl-1,3-propanediol, 2,2,4-trimethyl-1,3-pentanediol, 2-methyl-2,4-pentanediol, 2,4-dimethyl-2,4-pentanediol, and 2,4-hexanediol. It should be noted that some of the foregoing nomenclature emphasizes the -1,3-propanediol structure of the molecules, for clarity. For instance, 2-pentyl-1,3-propanediol might also be named 2-hydroxymethyl-1-heptanol, but the latter nomenclature does not so clearly illustrate the 1,3-nature of the diol. In yet other embodiments, the 1,3-propandiol may comprise 2-butyl-2-ethyl-1,3-propanediol (BEPD).

In further embodiments, the phosphonate ester mixture comprises the reaction product of (i) phosphonic acid or an ester thereof with an alcohol mixture comprising (ii) a propanediol, and (iii) an alkane diol having hydroxy groups in a 1,4 or 1,5 or 1,6 relationship. The propanediol (ii) will always be present in a greater amount than the alkane diol (iii) in the alcohol mixture. The reaction mixture includes at least 90 mole percent of the propanediol and from 1 to 10 mole percent of an alkane diol.

As noted above, the alkane diol (iii) is a 1,4- or 1,5- or 1,6-alkane diol with hydroxy groups in a 1,4 or 1,5 or 1,6 relationship to each other, separated by a chain of 4 to 8 or 4 to 6 carbon atoms. The first hydroxy group may be on the carbon 1 atom, that is, on the a carbon of the diol, or it may be on a higher numbered carbon atom. For example, the diol may also be a 2,5- or 2,6-, or 2,7-diol or a 3,6- or 3,7- or 3,8-diol, as will be evident to the skilled person. The alkane diol may be branched (e.g., alkyl-substituted) or unbranched and in one embodiment is unbranched. Unbranched, that is, linear diols ($\alpha,\omega$-diols) include 1,4-butanediol, 1,5-pentane diol, and 1,6-hexanediol. Branched or substituted diols include 1,4-pentanediol, 2-methyl-1,5-pentanediol, 3-methyl-1,5-pentanediol, 3,3-dimethyl-1,5-pentanediol, 1,5-hexanediol, 2,5-hexanediol, and 2,5-dimethyl-2,5-hexanediol. For purposes of the disclosed technology, a diol having one or more secondary hydroxy groups (such as 2,5-hexanediol) may be referred to as an internal diol. In certain embodiments the alkane diol (iii) may be 1,6-hexanediol. In yet other embodiments, the propanediol (ii) may comprise 2-butyl-2-ethyl-1,3-propanediol (BEPD) and the alkane diol (iii) may comprise 1,6-hexanediol. The ratio of the BEPD to the 1,6-hexanediol may range from 95.5:4.5 to 99.5:0.5, or 96:4 to 99:1, or 98:2 to 99:1, or 97:3 to 99:1

The alkane diol (iii) may, if desired, have additional hydroxy groups, that is, more than two per molecule, or there may be exactly two. In one embodiment, there are exactly two hydroxy groups per molecule. Also, care should be taken to avoid excessive branching or crosslinking in the product, which could lead to undesirable gel formation. Such problems may be avoided by careful control of reaction conditions such as control of the ratio of reagents and the order of their addition, performing the reaction under suitably dilute conditions, and reacting under low acid conditions. These conditions can be determined by the person skilled in the art with only routine experimentation.

In yet other embodiments, the reaction mixture may include (iv) a monohydric alcohol having 1 to 12, or 1 to 8, or 2 to 8 or 2 to 4 carbon atoms. The monohydric alcohol may be present in the reaction mixture in an amount of up to 10 mole percent or up to 8 mole percent, or up to 6 mole percent, or up to 4 mole percent, or up to 2 mole percent. In other embodiments, the monohydric alcohol is present in the reaction mixture from 1 to 5 wt %. In some embodiments, the reaction mixture is free of, i.e., contains 0 mole percent, of monohydric alcohol.

The relative molar amounts of the phosphonic acid or monomeric ester thereof (a) and the total molar amounts of the diols (b) may be in a ratio of 0.9:1.1 to 1.1:0.9, or 0.95:1.05 to 1.05:0.95, or 0.98:1.02 to 1.02:0.98, or about 1:1.

The phosphonate ester mixture disclosed herein comprises at least one oligomeric species comprising 2 to 20 or 3 to 20 phosphorus atoms and at least one cyclic monomeric species comprising a single phosphorus atom. The phosphonate ester mixture further comprises a cyclic monomeric species comprising a single phosphorus atom and a chain of 3 carbon atoms derived from the propanediol. The cyclic phosphonate ester may comprise one phosphorus atom, one hydrogen, and one oxygen from the monomeric phosphonic ester reactant, and a carbon and oxygen containing moiety derived from the 1,3-propanediol (ii), as the 1,3-propylene diol is capable of either participation in oligomerization or cyclic ester formation. The oligomeric or polymeric species may typically comprise 2 or 3 to 20 phosphorus atoms, or alternatively 5 to 10 phosphorus atoms, linked together by alkyl groups derived from the 1,3-propanediol and/or the alkane diol having two hydroxy groups in a 1,4-, 1,5-, or 1,6-relationship, which are less readily able to cyclize with the phosphorus to form a cyclic monomeric species.

The oligomeric species of the phosphonate ester mixture may be represented by the following structure:

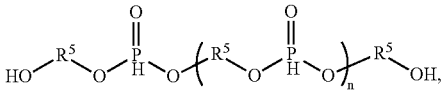

(oligomeric species)

wherein each $R^5$ is independently a linear or branched hydrocarbyl group of 3 to 24 carbon atoms, and n is an integer from 1 to 8. In one embodiment, the structure of the oligomeric species may be defined where $R^5$ is a branched hydrocarbyl of 6 to 14 carbon atoms.

The cyclic species of the phosphonate ester mixture may be represented by the following structure:

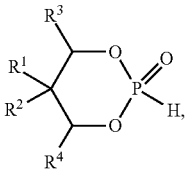

(cyclic species)

wherein, $R^1$, $R^2$, $R^3$, and $R^4$ are independently selected from one of hydrogen, a hydrocarbyl groups of 1 to 24 or 1 to 12 carbon atoms. In one embodiment, the cyclic species structure may be defined where $R^3$ and $R^4$ are hydrogen atoms; and $R^1$ and $R^2$ are both hydrocarbyl groups of 1 to 12 carbon atoms, or 1 to 8 carbon atoms, or 1 to 6 carbon atoms, or 2 to 6 carbon atoms.

In is noted that corresponding structures of the phosphonate ester mixture may be formed from different alkane diols and 1,3-propanediols.

The relative amounts of oligomeric species and cyclic monomer species in the reaction mixture will depend, to some extent, on the specific diols selected and the reaction conditions. When using only 1,3-propanediol and no alkane diols having two hydroxy groups in a 1, 4 or 1, 5 or 1, 6 relationship, the phosphonate esters formed will be, for example, about 80% cyclic to about 20% oligomeric (80:20 cyclic:oligomeric) by weight of the total weight of the esters formed.

For reaction products prepared from 1,6-hexane diol and 2-butyl-2-ethyl-1,3-propanediol, as in the structures above, generally less than 40 mol % of 1,6 hexane diol and at least 40 mol % of the 1,3-propanediol is used as using these alcohols in a ratio of 40:60 mol % results in a phosphonate ester that is 50:50 cyclic:oligomer by weight. The amount of cyclic product obtained by reaction at 135° C. may be approximately as shown in the table below:

| | | |
|---|---|---|
| mol % 1,6-hexane diol | 4.5 | 1 |
| mol % 2-butyl-2-ethyl-1,3-propanediol | 95.5 | 99 |
| wt % cyclic | 78 | 88 |

In one embodiment, the phosphonate ester mixture includes 50 wt % or greater of the cyclic phosphonate and 50 wt % or less of the oligomeric phosphonate. In another embodiments, the phosphonate ester mixture includes 60 wt % or greater of the cyclic phosphonate and 30 wt % or less of the oligomeric phosphonate. In some embodiments, the phosphonate ester mixture includes 65 wt % or greater of the cyclic phosphonate and 27 wt % or less of the oligomeric phosphonate. In some embodiments, the phosphonate ester mixture includes 70 wt % or greater of the cyclic phosphonate and 25 wt % or less of the oligomeric phosphonate. In some embodiments, the phosphonate ester mixture includes 75 wt % or greater of the cyclic phosphonate and 22 wt % or less of the oligomeric phosphonate. In some embodiments, the phosphonate ester mixture includes 80 wt % or greater of the cyclic phosphonate and 20 wt % or less of the oligomeric phosphonate. In some embodiments, the phosphonate ester mixture includes from 60 to 85 wt % of the cyclic phosphonate and from 15 to 30 wt % or less of the oligomeric phosphonate.

The condensation reaction between the phosphonic acid or ester and the diol mixture may be accomplished by mixing the reagents and heating until the reaction is substantially complete. Alternatively, the phosphonic acid or ester may be added slowly to a pre-heated mixture of the diols. Typically, if a mixture of diols is used, both diols will be mixed with the phosphonic acid or ester compound at the same time or nearly the same time, that is, typically before the reaction with one of the diols is complete. A small amount of a basic material such as sodium methoxide may also be present. If a methyl ester of phosphonic acid is used as a reagent, substantial completion of the reaction may correspond with the cessation of evolution and distillation of methanol from the reaction mixture. Reduced pressure may be advantageously employed in the later stages of the reaction to aid in the removal of residual methanol. Suitable temperatures include those in the range of 100 to 140° C., such as 110 to 130° C. or 115 to 120° C. If reaction temperatures in excess of about 140° C. are employed, there is a risk that the desired product may not be formed in useful yields or with useful purity, since competing reactions may occur. Reaction times may typically be up to 12 hours, depending on temperature, applied pressure (if any), agitation, and other variables. In some instances, reaction times of 2 to 8 hours or 4 to 6 hours may be appropriate.

The amount of the phosphonate ester mixture described above used instant grease compositions may be an amount sufficient to provide 0.01 to 0.3 or to 0.1 weight percent phosphorus to the grease composition. Suitable amounts of the phosphonate ester mixture in the grease composition may be 0.05 to 0.5, or 0.05 to 0.75, or 0.05 to 1.0, or 0.1 to 1.0, or 0.2 to 1.0, or 0.3 to 1.0, or 0.4 to 1.0, or 0.5 to 1.0 weight percent.

Metallic Soap Thickener

Thickeners useful in the instant grease composition include simple metallic soap thickeners, metal salts of such acid-functionalized oils, or mixed soap thickeners in which one fatty acid is reacted with two different metals.

In one embodiment, the metallic soap thickener comprises the reaction product of a complexing acid and a metal compound selected from lithium hydroxide, calcium hydroxide, sodium hydroxide, and mixtures thereof.

In one embodiment, the metallic soap thickener may be a lithium soap. In another embodiment, the metallic soap thickener may be a calcium soap. In still another embodiment, the thickener may be a mixed lithium and calcium metallic soaps. In another embodiment, the thickener may be an aluminum complex soap. Such metallic soap thickeners and the preparation thereof are well known in the art.

In one embodiment, the metal hydroxide is selected from lithium hydroxide, calcium hydroxide, sodium hydroxide, or mixtures thereof. In another embodiment, the metal hydroxide comprises or consists of lithium hydroxide. In still another embodiment, metallic soap thickener comprises or consists of a lithium hydroxide based metallic soap thickener and is present in the grease composition in an amount sufficient to deliver 400 ppm to 3000 pm of lithium to the open gear lubricant composition. In some embodiments of the invention, the metallic soap thickener may include other metals which may be contained in the metal hydroxide as impurities, but which are not intentionally added to the composition.

In one embodiment, the complexing acid used in the manufacture of the metallic soap thickener is derived from a natural plant or animal oil. Examples of plant derived acids are oleic acid, 12-hydroxystearic acid, and ricinoleic acid. Hydrogenated castor oil, an impure derivative of castor oil containing glycerol, glycerides and 12-hydroxystearic acid may also be useful in preparing metallic soap thickeners. An example of animal derived fat is beef tallow.

The grease compositions disclosed herein may include from about 2% to about 55 wt % of the metallic soap thickener, for example 2 wt % to 20 wt % or even 3 wt % to 15 wt % of metallic soap thickener based on the total weight of the grease composition.

Other Additives

The grease composition of the present invention may also include one or more other additives. Such additives, either alone or in combination, may be present at levels of from 0% by weight to about 20% by weight, or 0.1% by weight to about 15% by weight, or about 0.5% to about 15% by weight of the total weight of the grease composition.

Other performance additives useful in the grease composition include, but are not limited to, metal deactivators, viscosity modifiers, detergents, friction modifiers, anti-wear agents, corrosion inhibitors, tackifier, extreme pressure (EP) agents, antioxidants, and mixtures thereof. Typically, a fully formulated grease compositions may contain at least one or more of these performance additives.

Antioxidants may be selected from diarylamine, alkylated diarylamines, hindered phenols, molybdenum compounds (such as molybdenum dithiocarbamates or molybdenum disulfide), hydroxyl thioethers, trimethyl polyquinoline (e.g., 1,2-dihydro-2,2,4-trimethylquinoline), or mixtures thereof. In one embodiment the grease composition includes at least one antioxidant and may contain a mixture of antioxidants. The antioxidant may be present at levels of 0% by weight to about 5% by weight, or about 0.05% by weight to about 3% by weight, or about 0.1% by weight to about 2.5% by weight, or about 0.2% by weight to about 1.5% by weight, or about 0.3% by weight to about 1% by weight of the total weight of the grease composition.

In one embodiment, diarylamine and alkylated diarylamine used in the grease composition herein may be selected from a phenyl-α-naphthylamine (PANA), an alkylated diphenylamine, or an alkylated phenylnapthylamine, or mixtures thereof. In another embodiment, the alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines. The alkylated diarylamine may be a tetra-alkylated diarylamine.

Hindered phenol antioxidants may also be useful in the grease composition. Hindered phenol antioxidants often contain a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester. A commercially available example of a hindered phenol ester antioxidant is IRGANOX™ L 135 from BASF. A detailed description of suitable ester-containing hindered phenol antioxidant chemistry is found in U.S. Pat. No. 6,559,105.

In one embodiment, the grease composition may further comprise a polymeric additive which may function as a tackifier or thickener. Useful tackifiers are known in the art and may include hydrogenated styrene-butadiene rubbers, ethylene-propylene copolymers, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof. Tackifiers, such as those described in U.S. Pat. No. 6,300,288 may also be useful in this invention.

In one embodiment, the grease composition may include a polymeric viscosity modifier. The polymeric viscosity modifier suitable in the present grease composition may be selected from polyolefins different from the ethylene-propylene copolymers used in the mixture of ethylene-propylene copolymers described herein, polymethacrylates, polyacrylates, or styrene-maleic anhydride copolymers reacted with an amine. In one embodiment, the polymeric viscosity modifier may comprise or consist of a polyolefin may be a polymer or oligomer of isobutene or butene or polyisobutylene having a number average molecular weight of 400 to 4000. In one embodiment, if a polymeric viscosity modifier is used in the present invention, it may be included in amounts of 2 wt % to 30 wt %, or even 3 wt % to 28 wt %, or even 5 wt % to 25 wt % of the grease composition.

In one embodiment, the grease composition may also comprise an overbased metal-containing detergent. The overbased metal-containing detergent may be a calcium, sodium, or magnesium overbased detergent.

The overbased metal-containing detergent may be selected from the group consisting of non-sulfur containing phenates, sulfur containing phenates, sulfonates, salixarates, salicylates, and mixtures thereof, or borated equivalents thereof. The overbased metal-containing detergent may be selected from the group consisting of non-sulfur containing phenates, sulfur containing phenates, sulfonates, and mixtures thereof. The overbased detergent may be borated with a borating agent such as boric acid such as a borated overbased calcium, sodium, or magnesium sulfonate detergent, or mixtures thereof.

In one embodiment, the grease composition may contain a friction modifier. The friction modifier may be present at levels of 0% to about 6% by weight, or about 0.01% by weight to about 4% by weight, or about 0.05% by weight to about 2% by weight, or about 0.1% by weight to about 2% by weight of the total weight of the grease composition.

Friction modifiers may include materials such as sulfurized fatty compounds and olefins, molybdenum dialkyldithiophosphates, molybdenum dithiocarbamates, or other oil soluble molybdenum complexes. Commercially available friction modifiers include MOLYVAN® 855 (commercially available from Vanderbilt Chemicals LLC) or SAKURA-LUBE® S700 or SAKURA-LUBE® S710 (commercially available from Adeka, Inc.).

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of LUVODOR® MB or LUVODOR® MBO (commercially available from Lehmann and Voss GmbH). The oil soluble molybdenum complexes may be present at 0% by weight to 5% by weight, or 0.1% by weight to 5% by weight or 1% by weight to 3% by weight of the total weight of the grease composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

In one embodiment, the grease composition comprises an anti-wear agent. Examples of suitable anti-wear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis(S-alkyldithiocarbamyl) disulfides, and oil soluble phosphorus amine salts. In one embodiment the grease composition may further include metal dihydrocarbyldithiophosphates (such as zinc dialkyldithiophosphates).

In one embodiment, the grease composition comprises an extreme pressure agent. The extreme pressure agent may be a compound containing sulfur and/or phosphorus and/or nitrogen. Examples of an extreme pressure agents include a polysulfide, a sulfurized olefin, a thiadiazole, or mixtures thereof.

Examples of a thiadiazole extreme pressure agent include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment, polysulfide extreme pressure agents are used wherein at least 50% by weight of the polysulfide molecules are a mixture of tri- or tetra-sulfides. In other embodiments at least 55% by weight, or at least 60% by weight of the polysulfide molecules are a mixture of tri- or tetra-sulfides.

In one embodiment, a polysulfide extreme pressure agent may include a sulfurized organic polysulfide from oils, fatty acids or ester, olefins or polyolefins. Oils which may be sulfurized include natural or synthetic fluids such as mineral oils, lard oil, carboxylate esters derived from aliphatic alcohols and fatty acids or aliphatic carboxylic acids (e.g., myristyl oleate and oleyl oleate), and synthetic unsaturated esters or glycerides. Fatty acids which may be sulfurized include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

Polysulfide extreme pressure agents also may include sulfurized olefins derived from a wide range of alkenes. The alkenes typically have one or more double bonds. The sulfurized olefins in one embodiment contain 3 to 30 carbon atoms. In other embodiments, sulfurized olefins contain 3 to 16, or 3 to 9 carbon atoms. In one embodiment the sulfurized olefin includes an olefin derived from propylene, isobutylene, pentene or mixtures thereof. In one embodiment, the polysulfide comprises a sulfurized polyolefin derived from polymerizing by known techniques an olefin as described above.

In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present in the grease composition at a level of 0% by weight to about 5% by weight, about 0.01% by weight to about 4% by weight, about 0.01% by weight to about 3.5% by weight, about 0.05% by weight to about 3% by weight, about 0.1% by weight to about 1.5% by weight, or about 0.2% by weight to about 1% by weight of the grease composition.

In one embodiment, the grease composition may also comprise a metal deactivator. Useful metal deactivators may include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Corrosion inhibitors useful for a mechanical device include 1-amino-2-propanol, amines, triazole derivatives including tolyltriazole, dimercaptothiadiazole derivatives, octylamine octanoate, condensation products of dodecenyl succinic acid or anhydride and/or a fatty acid such as oleic acid with a polyamine.

In one embodiment, the grease composition includes a boron compound, for example, a dispersed potassium borate or potassium borate salt. In one embodiment, the boron compound, such as dispersed potassium borate, may be present in the grease composition in amounts of up to 10% by weight of the grease composition.

In another embodiment, the grease may include a solid lubricant which may be a carbonaceous component, such as amorphous carbon, graphite or carbon black. The carbonaceous component may be at levels of 0% to about 6% by weight, or about 0.01% by weight to about 4% by weight, or about 0.05% by weight to about 2% by weight, or about 0.1% by weight to about 2% by weight of the total weight of the grease composition.

In another embodiment, the grease composition of the present invention comprises a phosphorous compound in an amount to deliver 300 ppm to 2000 ppm, phosphorous to the grease composition. For example, the phosphorous compound may comprise or consist of a metal dialkyl phosphate. In one embodiment, the phosphorous compound may comprise or consist of zinc dialkyl dithiophosphate.

In another embodiment of the present invention, the grease composition contains a sulfur-containing molybdenum compound, such as from molybdenum disulfide, molybdenum dithiocarbonate, and combinations thereof. Molybdenum disulfide may also be used as a solid lubricant.

INDUSTRIAL APPLICATION

The grease composition of the present invention may be employed to in applications requiring a lubricant, grease, open gear composition.

Lubricating grease is a non-Newtonian semi-solid material, and its viscosity cannot be measured in the same way that a measurement would be made for a liquid lubricant. Rather, the "consistency" of a grease refers to how stiff the grease is under prescribed test conditions. Grease consistency is measured by a cone penetration test. Such tests are defined by various standards such as ISO 2137, ASTM D217, or ASTM D1403. The results of this test allow a consistency class e.g., #2 to be assigned to the grease according to a classification system established by the NLGI (formerly known as the National Lubricating Grease Institute). Softer greases will generally have a higher penetration number according to cone penetration tests. Comparisons of grease properties are generally done for greases in the same consistency class. In the present disclosure, the grease compositions have a cone penetration of 0 or 00 as measured ASTM D1403.

The grease compositions disclosed herein may be evaluated for wear in the Four Ball Wear of Grease test (ASTM D2266). This test is designed to compare lubricants in steel-on-steel applications. In addition, the ability of grease compositions to protect against extreme wear properties is evaluated in load carrying tests, such as ASTM D2596, which provides load-wear index, weld point, and last non-seizure load (LNSL) for lubricating grease compositions. The grease compositions may further be evaluated for copper corrosion (ASTM D4048) and iron corrosion (or rust) (ASTM D1743).

While the grease disclosed herein is characterized has a profile of a grease based on cone penetration tests, an open gear lubricant contemplated herein has no discernable dropping point. Typically, dropping point is a property used to define a grease. The dropping point is the temperature at which grease becomes soft enough to allow oil and material to separate from the matrix of the grease and fall from the orifice of the testing apparatus. The dropping point of a grease can be measured by various tests, such as ISO 2176 (ASTM D566), ASTM D2265, or IP 396 Automatic Dropping point test. However, open gear lubricants of the stiffness of the present invention are fluid enough that they typically do not remain in the apparatus long enough to provide a repeatable measurement. As used herein "no discernable dropping point" means that the stiffness of the open gear lubricant is such that it will not give a repeatable measurable dropping point using the methods set forth herein. In another embodiment, the open gear lubricant of the present invention may be characterized as having a dropping point of less than 50° C., or even less than 40° C., or even less than 30° C. because the open gear lubricant flows at ambient temperatures.

In an embodiment, the instant disclosure provides a method of operating a mechanical device comprising supplying to the mechanical device a grease composition including an ash-free phosphonate ester mixture comprised of a cyclic phosphonate of the following formula:

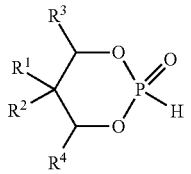

wherein, R1, R2, R3, and R4 are independently selected from one of hydrogen, a hydrocarbyl groups of 1 to 24 or 1 to 12 carbon atoms, and an oligomeric phosphonate of the following formula:

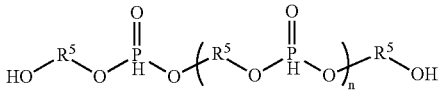

wherein, each R5 is independently a linear or branched hydrocarbyl group of 3 to 24 carbon atoms, and n is an integer from 1 to 8 and a metallic soap thickener.

The grease composition may be employed on a variety of mechanical devices, for example, draglines, rope shovels, and other mining equipment. Such equipment can operate under high loads, such as, for example, passing the 800 kg 4-ball weld test.

The grease composition disclosed herein may be better understood with reference to the following examples, which are non-exhaustive and are not intended to limit the scope of the invention.

EXAMPLES

Various phosphorus-containing anti-wear additives were evaluated for their ability to reduce or prevent wear in open gear lubricant, low viscosity grease compositions. The phosphorus additives include conventional dithiphosphate compounds, organic phosphites, and cyclic organic phosphonate compounds as summarized below (Table 1).

TABLE 1

Phosphorus-containing Anti-wear Agents

| | Description | % P | % S | % Zn | % N |
|---|---|---|---|---|---|
| P1 | Cyclic Phosphonate[1] | 14 | 0 | 0 | 0 |
| P2 | Mixed cyclic and oligomeric phosphonate[2] | 15 | 0 | 0 | 0 |

TABLE 1-continued

| Phosphorus-containing Anti-wear Agents | | | | | |
|---|---|---|---|---|---|
| | Description | % P | % S | % Zn | % N |
| P3 | Zinc dithiophosphate[3] | 8.5 | 17.6 | 9.25 | 0 |
| P4 | Dioleyl phosphite | 5.25 | 0 | 0 | 0 |
| P5 | Dithiophosphate bis-amide ester[4] | 6.8 | 14.1 | 0 | 2.9 |

[1]Cyclic phosphonate of 2-butyl-2-ethylpropane-1,3-diol (70 wt % cyclic species; 26 wt % oligomeric species)
[2]Mixture of cyclic phosphonate ester and oligomeric ester prepared from a mixture of 2-butyl-2-ethylpropane-1,3-diol and 1,6-hexanediol (60:40 mol %), (45 wt % cyclic species; 50 wt % oligomeric species)
[3]Zinc di(methylamyl)dithiophosphate
[4]S,S'-((methylenebis(azanediyl))bis(3-oxopropane-3, 1-diyl)) O,O,O',O'-tetra(iso)octyl bis (phosphordithioate)

A series of open gear lubricants were prepared to NLGI grade 0, according to ASTM D1403, 400 mm. The open gear lubricants were formulated with conventional additives and several different phosphorus anti-wear additives as summarized below (Table 2). Grease formulations were evaluated for their ability to reduce wear in the Four Ball Wear of Grease test (ASTM D2266). This test is designed to compare lubricants in steel-on-steel applications. In addition, the ability of grease compositions to protect against extreme wear properties is evaluated in load carrying tests, such as ASTM D2596, which provides load-wear index, weld point, and last non-seizure load (LNSL) for lubricating grease compositions. The ability of grease lubricating compositions to reduce and prevent corrosion is evaluated for copper corrosion (ASTM D4048) and iron corrosion (or rust) (ASTM D1743).

TABLE 2

| Grease Compositions[1] | | | | | | |
|---|---|---|---|---|---|---|
| Description | EX1 | EX2 | EX3 | EX4 | EX5 | EX6 |
| 12% lithium base grease[2] | 28 | 28 | 28 | 28 | 28 | 28 |
| Mineral base oil[3] | 52.7 | 52.7 | 52.7 | 52.7 | 52.7 | 52.7 |
| 3000 Mn Polyisobutylene | 2.8 | 2.8 | 2.8 | 2.8 | 2.8 | 2.8 |
| Graphite | 3 | 3 | 3 | 3 | 3 | 3 |
| Sulfurized diisobutylene | 3.25 | 3.25 | 3.25 | 3.25 | 3 | 3 |
| Sulfurized isobutylene | 4.95 | 4.95 | 4.95 | 4.95 | 4.95 | 4.95 |
| Sulfurized vegetable oil | 1.25 | 1.25 | 1.25 | 1.25 | 1.5 | 1.5 |
| P1 | | | | 1 | 1 | |
| P2 | | | | | | 1 |
| P3 | 1 | | | | | |
| P4 | | 1 | | | | |
| P5 | | | 1 | | | |
| Other Additives | 3.05 | 3.05 | 3.05 | 3.05 | 3.05 | 3.05 |
| Lithium (ppm) (calculated) | 760 | 760 | 760 | 760 | 760 | 760 |
| Phosphorus (wt %) (calculated) | 0.254 | 0.222 | 0.237 | 0.309 | 0.309 | 0.319 |
| Sulfur (wt %) (calculated) | 3.92 | 3.75 | 3.89 | 3.65 | 3.68 | 3.68 |
| Zinc (ppm) (calculated) | 925 | 0 | 0 | 0 | 0 | 0 |
| Wear scar (nm) | 0.82 | 0.84 | 0.78 | 0.64 | 0.49 | 0.61 |

[1]All treat rates are oil free (i.e. active) unless otherwise noted
[2]Lithium 12-hydroxystearate thickener in 150BS mineral oil (Lithium 0.27 wt %)
[3]150 Bright Stock mineral oil (Kinematic viscosity at 100 C. of 32 cSt)
[4]Other additives include phosphorus-containing EP agent, corrosion inhibitor, and tackifier.

As the results indicate, utilizing phosphorus anti-wear agents containing cyclic phosphonate structures provide improved wear protection compared to other conventional phosphorus anti-wear agents.

Unless otherwise stated herein, reference to treat rates or amounts of components present in the lubricating compositions disclosed herein are quoted on an oil free basis, i.e., amount of active. Further, unless otherwise stated, "wt %" as used herein shall refer to the weight percent based on the total weight of the composition on an oil-free basis.

"As used herein, the term "hydrocarbyl" refers to a group having a carbon atom directly attached to the remainder of the molecule, where the group includes at least carbon and hydrogen atoms. If the hydrocarbyl group comprises more than one carbon atom, then those carbons need not necessarily be linked to each other. For example, at least two of the carbons may be linked via a suitable element or group. In various embodiments, the term "hydrocarbyl" refers to a group having a carbon atom directly attached to the remainder of the molecule, where the group consists of carbon, hydrogen, optionally one or more heteroatoms to link at least two of the carbons, and optionally no more than two non-hydrocarbon substituents. Suitable heteroatoms will be apparent to those skilled in the art and include, for instance, sulfur, nitrogen, oxygen, phosphorus and silicon. Where the hydrocarbyl contains heteroatoms, no more than two heteroatoms will be present for every ten carbon atoms in the hydrocarbyl group. Suitable non-hydrocarbon substituents will also be apparent to those skilled in the art and include, for instance, halo, hydroxy, alkoxy, mercapto, alkylmercapto, nitro, nitroso, and sulfoxy. Examples of hydrocarbyls within the context of the present technology therefore include: (i) hydrocarbon groups selected from aliphatic (e.g. alkyl or alkenyl), alicyclic (e.g. cycloalkyl, cycloalkenyl, cycloalkadienyl), and aromatic groups; (ii) substituted hydrocarbon groups, selected from hydrocarbon groups defined in (i) substituted with no more than two non-hydrocarbon substituents and/or one or more hydrocarbon substituents, the non-hydrocarbon substituents being selected from the group consisting of halo, hydroxy, alkoxy, mercapto, alkylmercapto, nitro, nitroso, and sulfoxy; (iii) hetero-containing hydrocarbon groups, selected from hydrocarbon groups defined in (i) containing one or more heteroatom in the ring or chain, provided that the group has no more than two heteroatoms present for every ten carbon atoms in the group, the heteroatoms being selected from sulfur, nitrogen, oxygen, phosphorus and silicon. The hetero-containing hydrocarbon groups may be substituted with no more than two non-hydrocarbon substituents and/or one or more hydrocarbon substituents. Preferably the term "hydrocarbyl" refers to a group having a carbon atom directly attached to the remainder of the molecule, where the group consists of carbon and hydrogen atoms."

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only and is not intended to be limiting.

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure may be described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 wt. % refers to groups having 1, 2, or 3 wt. %. Similarly, a group having 1 to 5 wt. % refers to groups having 1, 2, 3, 4, or 5 wt. %, and so forth, including all points therebetween.

Moreover, where a recited range for a treat rate is provided, it is contemplated that such range shall include treat rates for individual components and/or a mixture of components. Thus, for example, a range of 1 to 3 wt % contemplates that a given component may be present in a range of 1 to 3 wt % or that a mixture of similar components can be present in a range from 1 to 3 wt %.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A grease composition comprising:

an ash-free phosphonate ester mixture comprised of 60 wt % or greater of a cyclic phosphonate of the following formula:

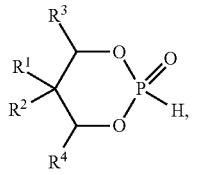

wherein, $R^1$, $R^2$, $R^3$, and $R^4$ are independently selected from one of hydrogen, a hydrocarbyl groups of 1 to 1224 carbon atoms, and 15 to 30 wt % of an oligomeric phosphonate of the following formula:

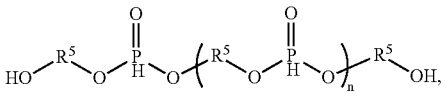

wherein, each $R^5$ is independently a linear or branched hydrocarbyl group of 6 to 14 carbon atoms, and n is an integer from 1 to 8; and a metallic soap thickener.

2. The grease composition of claim 1, wherein $R^3$ and $R^4$ are hydrogen atoms; and $R^1$ and $R^2$ are both hydrocarbyl groups of 1 to 12 carbon atoms.

3. The grease composition of claim 1, wherein the phosphonate ester mixture includes 65 wt % of cyclic phosphonate ester and 27 wt % or less of oligomeric phosphonate.

4. The grease composition of claim 1, wherein the metallic soap thickener comprises the reaction product of a complexing acid and a metal compound selected from lithium hydroxide, calcium hydroxide, sodium hydroxide, and mixtures thereof.

5. The grease composition of claim 1, wherein the metallic soap thickener is present in an amount to deliver 500 ppm to 3000 ppm lithium to the composition.

6. The grease composition of claim 4, wherein the complexing acid comprises 12-hydroxycarboxylic acid.

7. The grease composition of claim 6, wherein the 12-hydroxycarboxylic acid is 12-hydroxystearic or ricinoleic, or mixtures thereof.

8. The grease composition of claim 1, where the metallic soap thickener is present in an amount of from 2% to 55% by weight of the grease composition.

9. The grease composition of claim 1, wherein the composition is substantially free of zinc.

10. The grease composition of claim 1, wherein the composition further includes one or more additional additives selected from solid lubricants, sulfur-containing extreme pressure (EP) agents, corrosion inhibitors, antioxidants, polymeric additives, and combinations thereof.

11. The grease composition of claim 1, wherein composition further comprises a solid lubricant selected from graphite, carbon black, molybdenum disulfide, and combinations thereof.

12. The grease composition of claim 1, wherein the phosphonate ester mixture includes the reaction product of (i) phosphonic acid or an ester thereof with (ii) at least 90 mole percent of, an optionally substituted, 1,3-propane diol; and (iii) 1 to 10 mole percent of an alkane diol having two hydroxy groups separated by 4 to 8 carbon atoms.

13. The grease composition of claim 12, wherein the phosphonate ester mixture further comprises up to 10 mole percent of a monohydric alcohol having 1 to 12 carbon atoms.

14. The grease composition of claim 13, wherein the monohydric alcohol has 2 to 8 carbon atoms and is present as a reactant at 1 to 5 mole percent.

15. The grease composition of claim 12, wherein the 1,3-propanediol is substituted with one or more hydrocarbyl groups giving the 1,3-propane diol a total of 5 to 16 carbon atoms.

16. The grease composition of claim 15, wherein the substituted 1,3-propanediol is selected from 2-ethyl-2-butyl-1,3-propanediol, 2-ethylhexane-1,3-diol, 2,2-dibutyl-1,3-propanediol, 2-methyl-2-propyl-1,3-propanediol, or combinations thereof.

17. The grease composition of claim 12, wherein the alkane diol is selected from 1,4-butanediol, 1,5-pentanediol, 1,6-hexanediol, or mixtures thereof.

18. The grease composition claim 12, wherein the amount of the phosphonate ester mixture ranges from 0.05 to 0.5 wt %, based on a total weight of the grease composition.

19. A method for lubricating a mechanical device selected from one or more of draglines, rope shovels, and mining equipment, comprising supplying to a mechanical device a grease composition of claim 1.

20. The grease composition of claim 1, wherein the phosphonate ester mixture includes 70 wt % or greater of cyclic phosphonate and 25 wt % or less of oligomeric phosphonate.

* * * * *